United States Patent [19]

Robertson et al.

[11] Patent Number: 4,487,571

[45] Date of Patent: Dec. 11, 1984

[54] OIL COMBUSTION SYSTEM

[76] Inventors: Wayne Robertson, 1718 Linden Ave., Nashville, Tenn. 37212; Eugene C. Briggs; Keith E. Briggs, both of 1609 Harmony Way, Bowling Green, Ky. 42101

[21] Appl. No.: 443,441

[22] Filed: Nov. 22, 1982

[51] Int. Cl.[3] ..... F23D 11/44

[52] U.S. Cl. ..... 431/208; 73/863.61; 138/38; 239/124; 239/133; 239/590.5

[58] Field of Search ..... 239/124, 127, 132, 135, 239/433, 553, 553.5, 133, 318, 346, 369, 307, 590.5; 431/208; 73/863.61, 863.51; 138/37, 38; 137/578

[56] References Cited

U.S. PATENT DOCUMENTS

| | | | |
|---|---|---|---|
| 2,003,827 | 6/1935 | Esterling | 299/131 |
| 2,006,437 | 7/1935 | Burgess et al. | 239/369 X |
| 2,037,994 | 4/1936 | Neubauer | 137/561 A |
| 2,066,607 | 1/1937 | Burgess et al. | 239/369 X |
| 2,219,917 | 10/1940 | Crosiar | 158/76 |
| 2,224,403 | 12/1940 | Lines | 219/39 |
| 2,296,713 | 9/1942 | Hinsch | 137/578 |
| 2,306,831 | 12/1942 | Proctor | 219/39 |
| 2,802,520 | 8/1957 | Trabilcy | 158/36 |
| 2,909,638 | 10/1959 | Trabilcy | 219/39 |
| 2,967,923 | 1/1961 | Reilly | 219/19 |
| 3,081,948 | 3/1963 | Weiss | 239/369 |
| 3,227,204 | 1/1966 | Dibert | 158/36.3 |
| 3,369,608 | 2/1968 | Day | 219/300 |
| 3,381,709 | 5/1968 | Pregno | 137/578 |
| 3,512,363 | 5/1970 | Whear | 137/861 |
| 3,591,088 | 7/1971 | Green | 239/307 |
| 3,760,874 | 9/1973 | Boskovic | 138/38 |

FOREIGN PATENT DOCUMENTS

| | | | |
|---|---|---|---|
| 234255 | 6/1964 | Austria | 431/208 |
| 1309435 | 10/1962 | France | 239/307 |

*Primary Examiner*—Samuel Scott
*Assistant Examiner*—Allen J. Flanigan
*Attorney, Agent, or Firm*—Luededa & Neely

[57] ABSTRACT

The specification discloses an oil combustion system for burning waste oil in which oil is pumped by an oil transfer pump from an oil reservoir through a bouyant swirling filter. The oil is supplied to a high pressure input of a pressure reducing fitting, and is transmitted through the fitting to a low pressure output and a high pressure output. A siphon nozzle head is operable to siphon the oil from the low pressure output of the fitting, to preheat the oil, to atomize the oil and to output the atomized oil. Retention chambers and heat transfer plugs within the nozzle head facilitate preheating of the oil and perform a baffle function.

16 Claims, 10 Drawing Figures

OIL COMBUSTION SYSTEM

The present invention relates to oil combustion systems and particularly relates to an oil combustion system for burning heavy waste oils such as used motor oil.

There has long been a need for a simple, inexpensive, reliable waste oil burner. In the United States over two billion gallons of oil are purchased annually for such uses as automotive lubricants, truck and fleet lubricants, transmission fluids, gear lubricants, railway, aircraft and marine engine oil, gas engine oils, hydraulic oils, metal working, spindle, transformer oils, etc. A significant percentage of this oil is available as used oil. For example, service stations, garage and auto repair establishments that change the oil and other lubricants in vehicles have such oil available to them for reuse. At present, most of this oil is either dumped or reprocessed in part at a substantial expense. For most of these businesses, burning the used oil for space heating or water heating makes good economic sense. However, few of these establishments do burn the oil because of the cost and the present state of the art of heating units available for such purposes. The main problem in burning used oil is high viscosity and contamination in the oil making it difficult to pump and burn efficiently.

There are three basic approaches to burning the used oil: pot vaporizing, high pressure atomizing, and low pressure atomizing. The pot vaporizing burner is the simplest design. In this type of system, the used oil is heated in a pot until it begins to vaporize. The vapors are mixed with air in the presence of a flame to ignite them. The disadvantages of this type of system include the requirement for manual lighting, the requirement for the use of kerosene or a similar light fuel to preheat the pot and ignite the heavy oil vapors, and the requirement that the pot and system be cleaned and maintained daily. The overall inefficiency and need for cleaning are increased because the heavier oil fractions are not burned and accumulate in the pot as residue. This type of burner is difficult to regulate and is generally not available with automatic thermostatic controls.

High pressure atomizing units are the standard type of burner used in fuel oil furnaces. In this type of unit, a pump forces oil through a precision nozzle at a high pressure causing the oil to atomize. Usually an electric spark then ignites the atomized air and oil mixture. The use of a high pressure atomizer with heavy oil or heavy waste oil presents a number of serious problems. The heavy oil will not atomize properly at standard pump pressures, and often it is necessary to preheat the oil because of its higher viscosity. Also, it may be necessary to pressurize the oil up to approximately three hundred pounds per square inch. Because of the high pump pressures necessary when using heavy oil, a high pressure atomizing burner would require an extremely small orifice through which the oil must pass in order to obtain the desired volume of oil flow and proper atomization. This small orifice results in an increased stress on the pump and very small particles. Thus, extensive filtering is required, and even then, the large number of smaller contaminants generally present in waste oil will quickly injure the pump, injure or clog the nozzle. In general, the close tolerances and precision required by high pressure atomizing burners renders them unsuitable for use in burning waste oil.

The third and most promising approach is low pressure air atomizing burners. In these units, compressed air contacts the oil atomizing it before or as it leaves the nozzle where it is ignited by an electric spark. The greatest initial advantage of this approach over the high pressure atomizing unit is the large increase in nozzle orifice size for the same volume of oil. However, the problems remaining using this approach include carbon deposits produced by preheating, thermal expansion, extensive filtering and dewatering requirements, special pump requirements, special oil preheating requirements and general control problems in pumping and preheating waste oil.

Heavy oil, such as most waste oil, requires low wattage preheating per square inch or it will carbonize. Typically, expensive circulating immersion heaters are used to preheat heavy oil. This type of preheater is expensive to buy and operate; it requires heating a larger volume of oil than is needed; and the oil must be heated at some distance from the nozzle. This type of preheating requires a strong vessel with a thermostat, overflow pipe, venting and a valve to release accumulated water pressure, and failure of the thermostat to function properly can cause substantial risk due to overheating and the accompanying likelihood of combustion or explosion outside of the combustion chamber.

Used oil also contains particles that can clog nozzles and pumps, and the water usually found in used oil tanks can cause frozen filters, frozen fuel lines, flame outs, abnormal combustion and variations in the amount of heat produced. The water and contaminants also provide an environment in which bacteria may flourish, and the bacteria may, in time, cause clogging problems.

As previously mentioned, the high viscosity of the oil in and of itself creates problems in filtering and pumping the oil from the storage tank to the burner. This problem is increased by legal requirements in many localities that require burners to be eight feet above the service station or garage floor.

Control of the flow of heavy oil, or metering heavy oil, is another problem associated with low pressure air atomizing that is related to the pumping problem. In typical units of this type, some type of metering valve and solenoid control must be added to control the flow or volume of oil that is being burned. Thermal expansion in the lines or fluctuation in the used oil's viscosity due to temperature changes or other causes can create wide variations in the oil flow which in turn will create wide variations in the heat produced by the burner. This variation in oil flow could also create an improper mixture of oil and air that would not burn properly in the burner. Also, the contaminants in the waste oil may clog the metering valve.

In conventional low pressure burners, special controls are generally necessary for purging to prevent nozzle drip or abnormal combustion on starting. Also, special seals usually must be used in a metering pump if the preheater device is to be allowed to preheat the oil over 160° F. Because of the positive pressure produced by a metering pump, additional controls may be required such as an air compression proving switch, combustion air proving switch, etc., for purging and to prevent nozzle drip or abnormal combustion.

The foregoing and other problems long associated with heavy oil burners are solved in the present invention by the provision of a combustion system utilizing a pressure reducing fitting to control oil flow and a preheated siphon nozzle head to siphon oil from the pressure reducing fitting at a predetermined rate of flow. In accordance with the present invention, an oil combustion system for transmitting and burning oil from a reservoir includes a pressure reducing fitting having at least one high pressure input and at least one low pressure output. The fitting is operable, when oil under pressure is supplied through the high pressure input, to transmit oil to the low pressure output and to reduce the pressure of the oil at the output relative to the oil pressure at the input. A pressurized oil supply provides oil at the high pressure input of the pressure reducing fitting, and oil conduit means having first and second ends is connected at its first end to the low pressure output of the pressure reducing fitting and transmits oil through its second end to a siphon nozzle. The siphon nozzle is connected for siphoning oil from the low pressure output of the pressure reducing valve through the oil conduit means at a predetermined rate of oil flow. As the oil is ejected from the siphon nozzle, it has been mixed with air and is in condition for being burned. The term "siphon" is used herein in its broad sense and shall be understood to refer to a suction effect. The term "siphon" is not intended to imply, or be limited to, flow caused by gravity. When the term "siphon" is used in reference to a nozzle, it will be understood to refer to an aspirating type nozzle that aerodynamically creates a siphon (or suction) effect to draw a liquid into and through the nozzle. This aerodynamic phenomenon is referred to as a venturi effect.

The pressure reducing fitting as described above may include a high pressure input for receiving oil from the reservoir under pressure and a high pressure output interconnected with the high pressure input for returning oil to the reservoir. A low pressure output is interposed between the high pressure input and high pressure output for supplying oil to the siphon nozzle through the oil conduit, and an obstruction is disposed between the high pressure input and the low pressure output for obstructing the flow of oil therebetween and thereby reducing the pressure of oil presented at the low pressure output to a predetermined low oil pressure relative to the oil pressure at the high pressure input. The obstruction, in the preferred embodiment, is a slotted cylinder mounted in the low pressure output and extending therefrom into the oil flow path between the high pressure input and high pressure output. A PTC thermistor may be mounted on the pressure reducing fitting, if necessary, to heat the oil and maintain a uniform oil viscosity.

The siphon nozzle that is used in the preferred embodiment includes a block with an oil input port formed in the block for receiving oil from the oil conduit. At least one oil retention chamber is formed in the block for receiving and retaining oil from the oil input port, and an oil output port is formed in the block to receive oil from the oil retention chamber and to transmit it to a nozzle socket that is formed in the block. A compressed air input supplies compressed air to the nozzle socket and a nozzle is provided, configured to fit within the nozzle socket for receiving and mixing compressed air and oil and being operable when compressed air is supplied to the nozzle through the compressed air input, to produce a suction at the oil output port to suck oil therefrom and through the nozzle. The block is heated by means of a positive temperature co-efficient thermistor mounted on the block adjacent to the oil retention chamber. The block contains at least one heat transfer plug mounted within the chamber to preheat the oil before it reaches the nozzle.

The oil retention chamber may include first and second oil retention chambers each with a heat transfer plug. In such embodiment, an interior passageway extends between the first and second oil retention chambers and the oil input port is formed in the block to supply oil to the first oil retention chamber at a level slightly below the nozzle level line and the interior passageway. In this configuration, the first and second oil retention chambers will retain oil when the system is not burning oil and the interior passageway may also function as an air passageway between the oil input port and oil output port so that the nozzle is automatically air purged by providing an air suction at the oil input port.

In one embodiment of the combustion system, an oil suction line supplies oil from the oil reservoir to the pressure reducing fitting to the reservoir. The ends of both the suction line and return line are mounted in a filter which includes a perforated container made, preferably, from perforated sheet material. A suction inlet is formed in the end of the suction line and discharge openings are formed in the end of the return line in a configuration and position for creating a swirling action around the suction inlet and against and through the perforated container. The swirling action of the return oil tends to reduce the possibility of large particles entering the suction inlet and it scrubs particles from the perforated container to prevent clogging. Also, because of the proximity of the return line to the suction line, much of the oil entering the suction line was emitted by the return line.

The filter is bouyant so that it will float at or near the upper surface of the oil in the reservoir, and it is constructed so that it is always spaced away from the bottom and sides of the tank. Preferably, a float is attached to the bottom of the filter to obtain the desired bouyancy and spacing.

The present invention may be best understood by reference to the Detailed Description of a preferred embodiment of the invention when considered in conjunction with the drawings in which.

Figure 1:
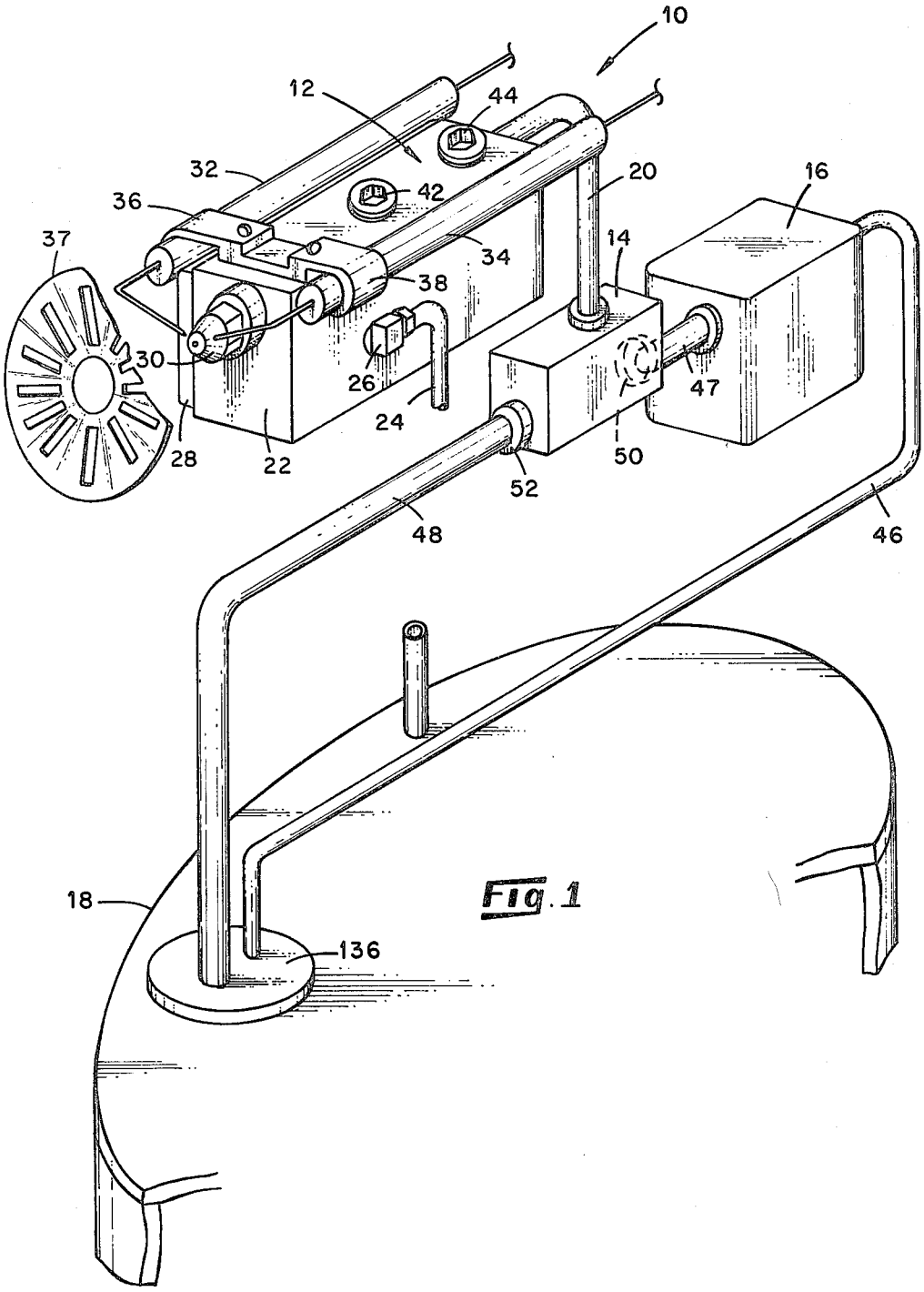
FIG. 1 is a diagrammatical perspective view of an oil combustion system embodying the present invention.

Referring now to the drawings in which like reference characters designate like or corresponding parts throughout the several views, there is shown in FIG. 1 a perspective diagramatical view of the oil combustion system 10 embodying the present invention that includes a siphon nozzle head 12 for siphoning oil from a pressure reducing fitting 14. Oil is supplied to the pressure reducing fitting 14 by a pump 16 that pumps oil from a reservoir tank 18 to the fitting 14, and the most of the pumped oil passes through the fitting 14 and back into the reservoir tank 18, except for the oil that is siphoned from the fitting by the nozzle head 12.

Referring in more detail to the construction of the nozzle head 12, it will be appreciated that a nozzle oil line 20 extends from the pressure reducing fitting 14 to the nozzle head 12 and supplies oil to the head 12. The nozzle oil line 20 threadably attaches to the rear of block 22, and an air line 24 is also connected to the block 22 through an air fitting 26 that is mounted on the side of the block. As the oil passes through the block 22, a positive temperature co-efficient thermistor 28 mounted on the side of the block 22 heats the oil to a predetermined desired temperature, and the heated oil and air are mixed by the nozzle 30. A positive termperature co-efficient thermister 28 may also be mounted on the pressure reducing fitting 14 in order to preheat the oil before it is transmitted to the head 12.

The nozzle 30 is a conventional siphon (or aspirating) type nozzle. Compressed air is supplied to the nozzle 30 at a pressure of about three to twenty p.s.i., and the nozzle 30 aerodynamically creates a suction in a well known manner to pull oil from the block 22. [This creates the high velocity vortex in the swirl chamber and discharge orifice providing a low pressure volume at the outlet of the liquid orifice of the nozzle to induce flow.] by the pressure reducing fitting 14 at a slightly negative pressure at the nozzle head 12. Actually, the pressure reducing fitting 14 produces oil at the fitting at a slightly positive pressure so that oil is forced partially up the nozzle oil line 20 by the pressure from the pressure reducing fitting. However, the pressure from the fitting is not sufficient to force oil to the nozzle head 12, and siphon provided by the nozzle 30 is necessary to draw the oil up the remaining distance of the nozzle oil line 20 and through the nozzle head 12. In the preferred embodiment, the nozzle head 12 is mounted approximately four inches above the pressure reducing fitting 14 and the fitting 14 raises the oil approximately one-half inch in the nozzle oil line 20. Thus, the suction from the nozzle 30 must be sufficient to raise the oil in the nozzle oil 20 line the remaining three and one half inches and to force the oil through the nozzle head 12 at a desirable flow rate. The flow rate can be varied by changing nozzle orifice size or air pressure. In this manner, nozzle 30 determines oil flow and performs a metering of the oil being burned.

A pair of electrodes 32 and 34 are mounted on the block 32 by electrode brackets 36 and 38. The electrodes 32 and 34 are positioned to provide an electric arc immediately in front of the nozzle 30 to ignite the atomized oil as it exits the nozzle 30 and the flame produced in front of the nozzle 30 is directed through a flame retention head 39 (shown broken away) that retains the flame to within a desired volume and increases the efficiency of the burn. The block 22 is also provided with two heat transfer clean-out plugs 42 and 44 whose function is hereafter described in greater detail.

The nozzle oil line 20 extending between the pressure reducing fitting 14 and the nozzle head 12 is a standard $\frac{1}{4}$ or $\frac{1}{8}$ inch oil line or tubing. Also, the fittings connecting the oil line 20 to the head 12 and fitting 14 are standard threaded fittings. The pump oil supply line 46 extending from the tank 18 to the pump 16 and the fitting oil supply line 47 extending from the pump 16 to the fitting 14 are likewise standard oil lines. A $\frac{5}{8}$ inch oil return line 48 connects the output of the pressure reducing fitting 14 and the tank 18 to return oil to the tank 18. The block 22 and the fitting 14 are constructed of a corrosion resistant metal such as aluminum, which is preferred, or stainless steel, and the pump 16 is a conventional oil burner pump. Typical oil flow through the pump will be, for most installations, between the range of two and one-half and twenty-five gallons per hour.

It will be noted that except for the oil that is withdrawn from the pressure reducing fitting 14 by the nozzle head 12, the pump 16 is pumping oil through a closed loop starting with the tank 18, through the pump 16, through the fitting 14, and returning to the tank 18. The input to which the fitting supply oil line 47 is connected is referred to herein as the high pressure oil input 50. The output to which oil return line 48 is connected is referred to as the high pressure output 52, and the output to which the nozzle line 20 is connected is referred to as the low pressure output 54 of the pressure reducing fitting 14.

The tank 18 is a vented oil tank such as typically found containing waste oil at a service station. The oil supply line 46 and the oil return line 48 are interconnected with a swirling bouyant oil filter 49 within the tank 18, the detailed construction of which is described hereinafter with reference to FIGS. 8, 9 and 10.

Figure 2:
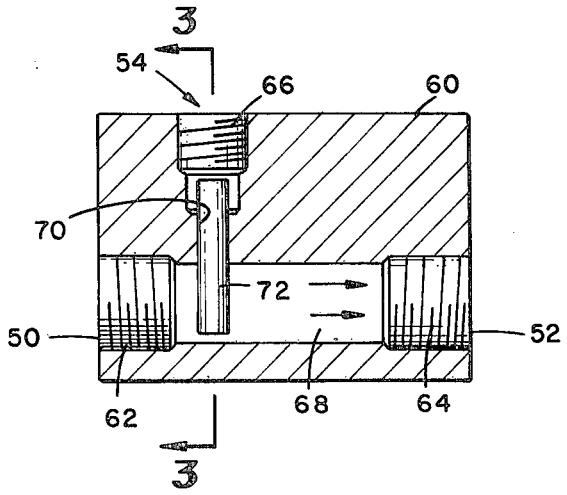
FIG. 2 is a side cross-sectional view of a block that forms a part of pressure reducing fitting.

Referring now to FIG. 2, there is shown a cross-sectional view of a block 60 that is a part of the pressure reducing fitting 14. The block 60 includes a high pressure input 50 the high pressure output 52 and the low pressure output 54 with threaded sockets 62, 64 and 66 being formed, respectively, in the input 50 and the outputs 64 and 66. These threaded sockets 62, 64 and 66 are configured to receive threaded fittings from the oil lines 47, 48 and 20. An oil passageway 68 is formed between the high pressure input 50 and the high pressure output 52 and the oil flow is generally indicated by arrows within the passageway 68. An oil passageway 70 intersects the oil passageway 68 and extends upwardly therefrom to the low pressure output 64. Oil is transmitted up the passageway 70 to the output 54 at a reduced pressure.

Figure 3:
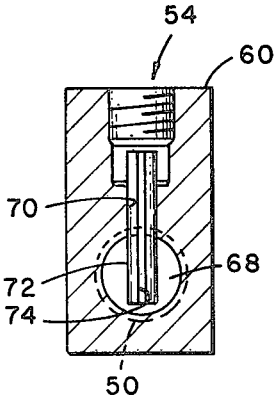
FIG. 3 is an end cross-sectional view of the pressure reducing fitting.

Referring now to FIG. 3, there is shown an end cross-sectional view of the block 60 shown looking into the block from the high pressure output 52. In this view, it will be appreciated that a cylinder 72 is force fitted in the passageway 70 and that the cylinder 72 includes a longitudinal slot 74 extending along the entire length of the cylinder 72. The cylinder, being friction fitted in the passageway 70, will not rotate and it is positioned with the slot 74 facing the high pressure output 52. The function of the cylinder 72 is to partially obstruct the oil passageway 68 and create a venturi effect that produces oil at the low pressure output 54 at a reduced pressure relative to the oil pressure at the high pressure output 50. The venturi effect created by the cylinder 72 will vary with size of the slot 74, the size of the cylinder, and the distance that the cylinder 72 extends into the passageway 68. In the preferred embodiment, the cylinder has a 3/16 inch diameter and has a one-sixteenth inch slot formed therein. The cylinder extends from the passageway 70 for a distance of approximately 5/16 of an inch into the passageway 68.

The oil flow rate through the passageway 68 is chosen so that the venturi effect created by the cylinder 72 will create a slightly positive oil pressure at the low pressure output 54 of the pressure reducing fitting 14. The dimensions of the block 60 and in particular the passageways 68 and 70 and the cylinder 72 and slot 74 are not critical except for the fact that they should be adjusted to produce the desired pressure at the low pressure output 54. Although it is preferred to produce a slightly positive pressure out the low pressure output 54, it is contemplated that in other embodiments it may be desirable to produce a slightly negative pressure at such output. In the embodiment shown, tl.e passageway 68 has a diameter of ⅜ of an inch, and the passageway 70 has a diameter of 3/16 of an inch.

Figure 4:
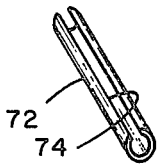
FIG. 4 is a perspective view of a slotted cylinder used as a part of the pressure reducing fitting.
Figure 5:
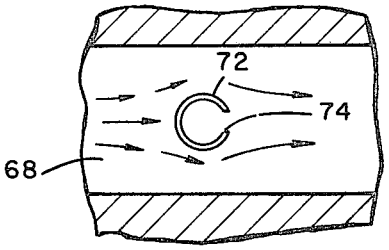
FIG. 5 is a flow diagram showing an end view of the slotted cylinder and illustrating oil flow around the cylinder in the pressure reducing fitting.

Referring now to FIG. 4, there is shown a perspective view of the cylinder 72 and slot 74, and in FIG. 5 there is shown an end view of the cylinder 72 with the arrows indicating oil flow around the cylinder 72. Since the slot 74 is facing the high pressure output 52, the oil flows against the opposite side of the cylinder and around the cylinder 72. As the oil flows around the cylinder 72, a vacuum effect or a venturi effect is created at the slot 74, thus reducing the pressure or producing a negative pressure relative to the oil pressure within the passageway 68. The reduced pressure created by the slot 74 reduces the pressure of the oil being forced upwardly through the passageway 70 as shown in FIG. 3.

Although the slotted cylinder 72 is the preferred obstruction to be placed in the passageway 68 to produce the reduced pressure, it is comtemplated that venturi type obstructions could be placed within the passageway to produce the reduced pressure effect that is desired. It is also contemplated that the passageway 68 could likewise be configured to produce a venturi effect. For example, the passageway 68 could be narrowed and then widened, or the passageway could begin as a narrow cylinder and then widen to an enlarged cylinder to produce the venturi effect. In these examples, the variations in the size of the cylinder walls are producing the obstruction effect or the venturi effect to create the reduced pressure. Thus, variations in the wall structure of the passageway 68 shall be considered obstructions.

Figure 6:
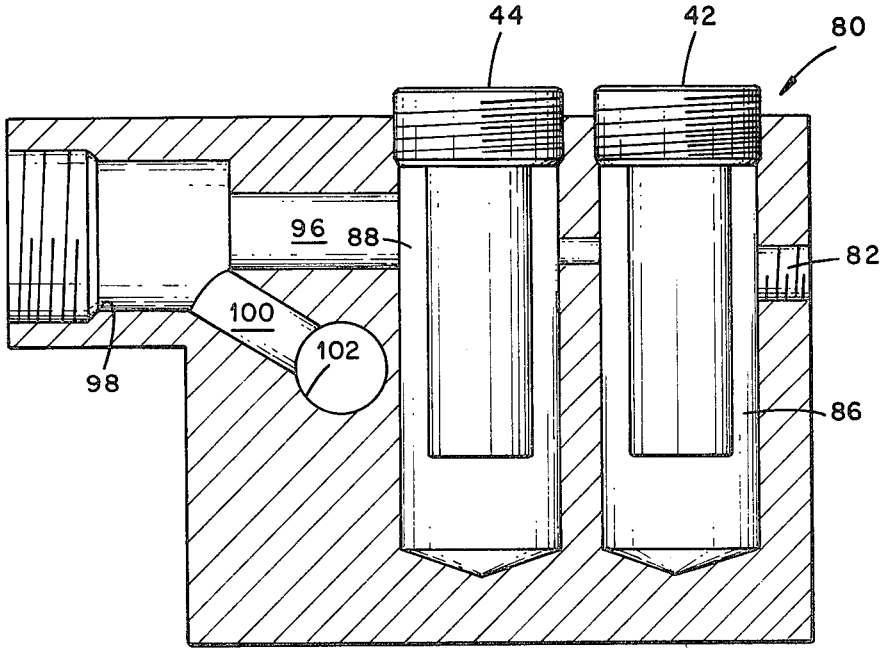
FIG. 6 is a side cross-sectional view of the nozzle head of the present invention.

Referring now to FIG. 6, there is shown a somewhat diagrammatical side cross-sectional view of a nozzle head block 80 that forms a part of the nozzle head 12. An oil input port 82 having an 11/32 inch diameter is formed in the rear side of the nozzle head block 80 and is adapted to connect to and receive oil from the nozzle oil line 20. Input port 82 extends between the exterior of the block 80 and the upper end of a first retention chamber 84 that is also formed adjacent the rear end of the block 80. The rentention chamber 84, in the preferred embodiment, is a cylinderical chamber having a 19/32 inch diameter, a length of 1.5 inches, and is formed by boring.

An oil passageway 86 having a ⅛" diameter is formed in the block 80 extending between the first retention chamber 84 and a second oil retention chamber 88. The second retention chamber 88 is identical to the first retention chamber 84 in dimension, and both retention chambers 84 and 88 have heat transfer plugs 42 and 44, respectively, threadably secured in the upper ends of the chambers. The plugs 42 and 44 are spaced apart from and are coaxial with the chambers 84 and 88, and in the preferred embodiment the plugs will have about two square inches of surface in contact with the oil inside the chambers.

An oil output port 96 having a 9/32 inch diameter extends from the upper end of the second retention chamber 88 towards the front of the block 80 and is interconnected with a nozzle socket 98 that communicates with the front end of the block 80. The nozzle socket 98 is threaded and adapted to receive a siphon nozzle, such as the nozzle manufactured by Delavan part no. 30609-0, and the function of the oil output port 96 is to transmit oil from the second retention chamber 88 to a nozzle mounted in the nozzle socket 98. A compressed air input port 100 is also formed in the block 80 extending from the rear portion of the nozzle socket 98 through the block 80 to a compressed air socket 102 that is adapted to receive a compressed air fitting, such as air fitting 26. Thus, compressed air is introduced into the block through the air input port 100 and is supplied to the rear end of the nozzle socket 98 and, thus, to the nozzle 30 when it is mounted in the socket 98.

When suction nozzle 30 is mounted, the nozzle socket 98 and compressed air is supplied to the nozzle through air input port 100, a suction force is applied to the oil output port 96 which creates a vacuum in retention chambers 84 and 88 and places a suction force on the oil input port 82.

The suction applied at output port 96 is communicated from retention chamber 88 to retention chamber 84 through the the passageway 86. Thus, when the suction force is first applied at output port 96, it is communicated to the retention chamber 84 through the passageway 86, and air is drawn from the oil input port 82 into retention chamber 84, through passageway 86, through retention chamber 88 and into port 96.

As the vacuum or siphon force is applied to the input port 82, oil will be drawn through the nozzle oil line 20 and begin to enter the first retention chamber 84 through the port 82, and eventually oil will pass through the passageway 86 into the first retention chamber 88. When both retention chambers 84 and 88 are filled to a level of the output port 96, oil will be sucked into the output port 96 and through the nozzle in the nozzle socket 98. Such oil flow will continue so long as the compressed air entering the nozzle socket 98 through the air input port 100 continues.

When the compressed air is turned off, the system 10 is designed to allow the oil to flow back down the nozzle oil line 20 through the pressure reducing fitting 14 and throuoh the return oil line 48 to the tank 18. As the oil flows down this path, a suction is created at input port 82 that pulls air through the nozzle mounted in nozzle socket 98. The passageway 86 is disposed at a level approximately equal to the level of output port 96, and both passageway 86 and output port 96 are above the level of input port 82. Thus, air will enter the second retention chamber 88 through the output port 96 and the level of oil in retention chambers 84 and 88 will drop until an air path is established between the output port 96 and the input port 82 through the retention chambers 84 and 88 and the passageway 86. In this manner, the nozzle in nozzle socket 98 is air purged and yet the retention chambers 84 and 88 retain a quantity of oil within the block 80 at a level beneath the level of input port 82.

Figure 7:
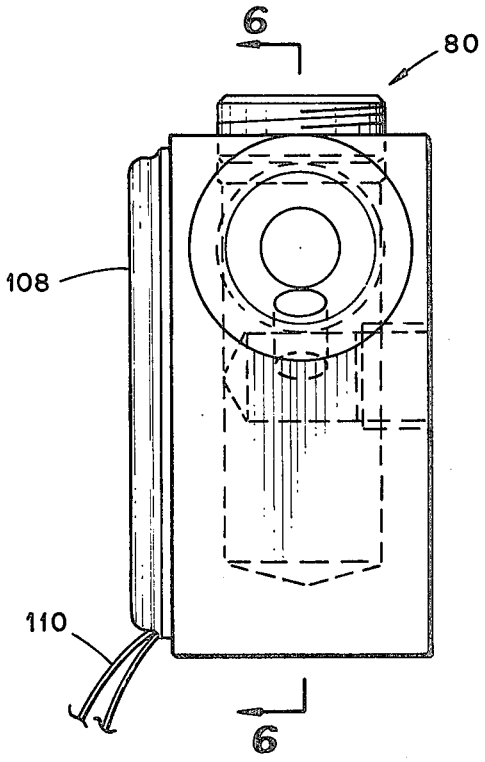
FIG. 7 is an end view of the nozzle head with dashed lines showing hidden structure.

The function of retention chambers 84 and 88 is to provide a preheating area for the oil prior to burning. Referring to FIG. 7, it is shown that a positive temperature co-efficient thermistor (a temperature sensitive resistor whose resistance varies rapidly with changing temperature at a selected temperature or Curie Point) is mounted on the lateral side of the block 80. The thermistor 108 is supplied electric current through lines 110 and is constantly maintained in an energized mode.

When the oil is not flowing to the block 80, the resistor 108 produces heat and the temperature of the resistor 108 begins to rise and, likewise, the resistance of resistor 108 begins to rise. Eventually an equilibrium is reached, and the temperature of the thermistor 108 will stabilize. The stabilized temperature of the thermistor 108 will vary with changes in the environment, but the typical stabilized temperature is one hundred degrees (100) Centigrade.

When the system 10 is not operating, the thermistor 108 will heat the oil retained in retention chambers 84 and 88 so that when the system is activated, the first oil burned will be the hot oil in the retention chambers 84 and 88. As oil begins to flow through block 80, its temperature will drop and, thus, the temperature of the thermistor 108 will drop slightly. As the temperature of the thermistor 108 drops, its resistance also drops and more current flows through the resistor creating more heat. Eventually, again, an equilibrium is reached and the temperature of the thermistor 108 will stabilize around one hundred degrees Centigrade. Again, the stabilized temperature of the thermistor 108 depends on the environment and the rate of oil flow through the block 80, but it will always be very near the Curie point temperature of the selected thermistor 108.

The heat transfer plugs 42 and 44 in retention chambers 84 and 88 perform heat transfer and a baffle-type function. Plugs 42 and 44 are heated by the block 80, or they may be heated by separate thermisters, and the heat from the plugs 42 and 44 is transferred to the surrounding oil. As the oil enters the first retention chamber 84, its progress toward the nozzle is slowed as it flows against and around plug 44 creating turbulence and a mixing effect (a baffling effect) in retention chamber 94. Thus, the oil entering input port 82 is heated by plug 44 and mixed with the pre-heated oil already present in chamber 84. The oil from chamber 84 is pulled through oil passageway 86 and against and around plug 42. A turbulence and mixing effect is, thus, created within chamber 88 further heating the oil. Within chambers 84 and 88, the oil is heated by the chamber walls and the turbulence created by the plugs facilitates this heating effect as well. Finally, the heated oil flows out of chamber 88, through the output port 96, and to the nozzle socket 98.

The primary function of the plugs 42 and 44 is the above described heating and baffling function, but the plugs may also be removed for cleaning purposes. When plugs 42 and 44 are removed, access is obtained to the chambers 84 and 86, the input port 82, the passageway 86, and the output port 96.

Although the low pressure atomization combustion system 10 of the present invention is designed to resist clogging due to particles or pollutants in the oil, it is still important that the system include a filtering system capable of efficiently and adequately filtering the heavily contaminated waste oil for which the system is designed. Typically, a pump for an oil burner, such as pump 16, will include a filter, but such filter will not usually be designed to filter waste oil and is likely to clog or otherwise malfunction. Thus, the present system 10 includes an in-tank filter 49 that is designed to operate in the oil reservoir or tank 18 to provide the initial filtering of the oil.

Figure 8:
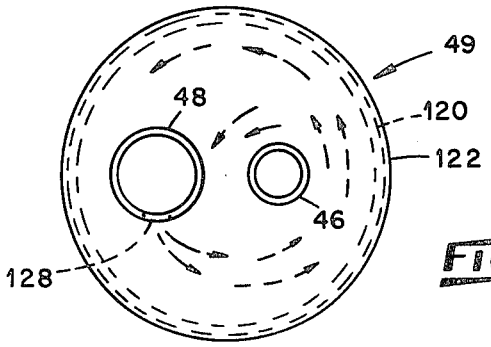
FIG. 8 is a top view of an in-tank oil filter used in the present invention.
Figure 9:
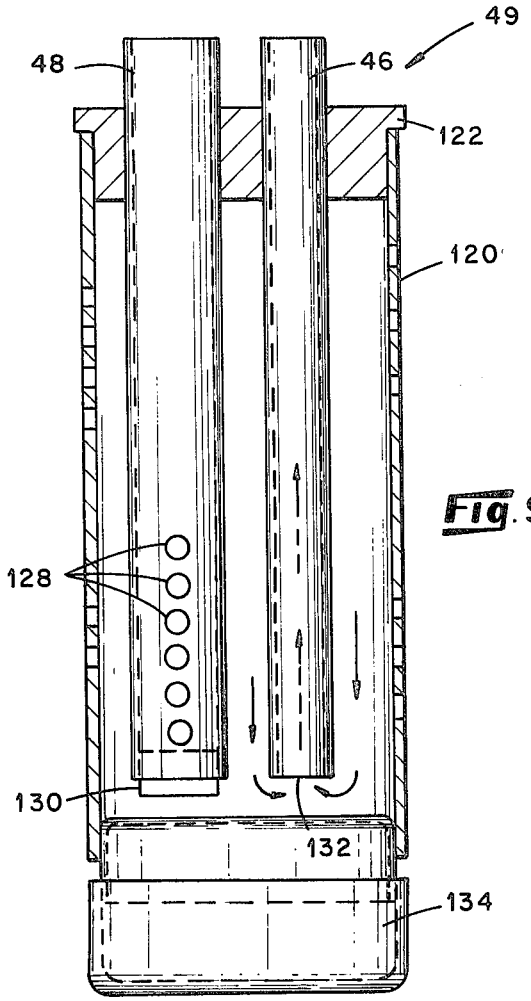
FIG. 9 is a somewhat diagrammatical cross-section of the in-tank filter.

A top cross-sectional view of filter 49 is shown in FIG. 8 and a somewhat diagrammatical side or lateral view of the filter 49 is shown in FIG. 9. As will be appreciated by reference to these two figures, the oil suction line 46 and the return line 48 are mounted within a container 120 in a side-by-side, spaced apart, parallel relationship. The container 120 is preferably cylindrical in shape and its side walls are constructed of perforated sheet metal, such as stainless steel sheet having perforations of a .018 inch diameter with 950 perforations per square inch, or in a less preferred embodiment, of a wire mesh. A top plug 122 is dimenstioned to fit snugly in the top opening of the cylindrical container 120 and is adhesively bonded therein. The lines 46 and 48 are rigidly and adhesively mounted in apertures 124 and 126 which are dimensioned to snugly receive lines 46 and 48, respectively.

Discharge outlets 128 are formed along the side of return lines 48 along its lower end which is closed by a plug 130, and the total cross-sectional area of outlets 128 is greater than the cross-sectional area of the line 48. As may be best seen in FIG. 8, the return line 48 is mounted in an off center position within container 120 and the discharge outlets 128 are oriented to discharge oil therefrom in a tangential direction relative to a radius of the cylindrical container 120. In this orientation, the discharge outlets 128 cause the oil within container 120 to swirl in a circular direction around the container 128 and around the suction line 46. The swirling action of the oil within the container causes the oil to scrub against the interior of the container 120 and through the perforations in the container which will scrub particles from the container. The suction line 46 has its inlet defined by the circular opening at its lowermost end. The swirling action around the suction line 46 also tends to force larger particles away from the suction line 46 and its inlet 132.

Both the suction line 46 and the return line 48 are constructed of smooth, flexible plastic tubing that will resist the deposit of sludge thereon. The container 120 is preferably perforated stainless steel.

A float 134 is dimensioned to snugly fit and is adhesively secured in the lower end to the container 120. The float 134 closes the container 120 so that the only oil entering the container 120 must pass through the perforations therein, and the float 134 provides bouyancy. The size and weight of the float 134 is chosen so that the filter will float near, but not on, the surface of the oil.

Figure 10:
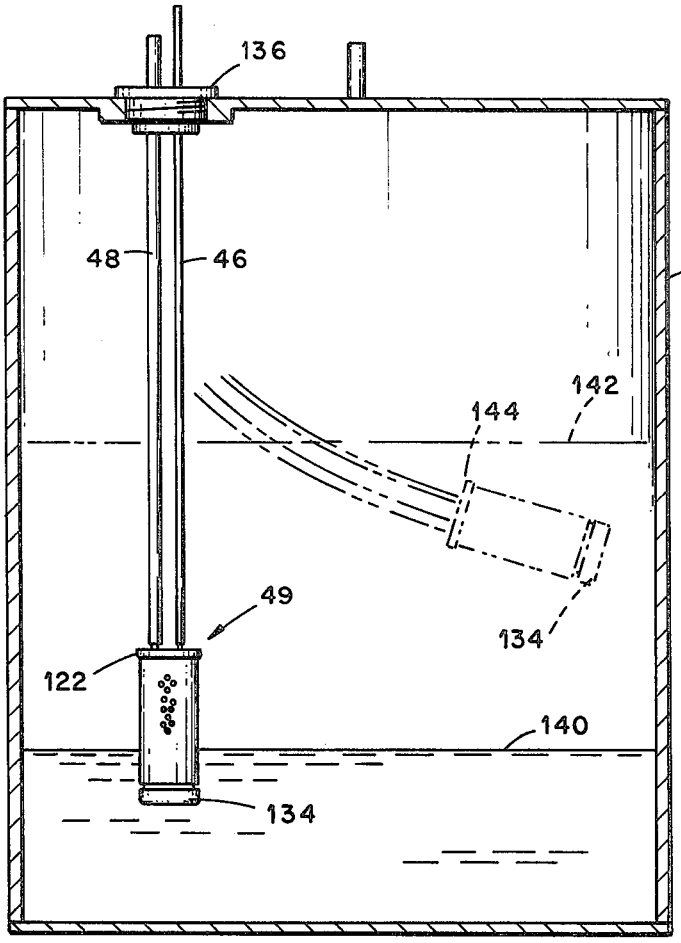
FIG. 10 is a side or plan view of the in-tank filter in an oil reservoir or tank.

As shown in FIG. 10, lines 46 and 48 are fixedly secured in a mount 136 that is attached to the tank 18. In the embodiment shown, the mount 136 is a threaded cap that fits in a threaded receptacle in the top of the tank 18, though other devices could work as well, so long as they fixedly hold lines 48 and 46.

The actual oil level in tank 18 is indicated by fuel level 140, and a second hypothetical oil level is indicated by fuel level 142, shown by dashed lines. At the actual fuel level 140, the filter no longer floats because the fuel (oil) level is too low, and the lines 46 and 48 are dimensioned with a sufficiently short length that the filter hangs immediately above the bottom of tank 18. In this construction, the filter will never touch the bottom of tank 18 and, thus, will not disturb or attempt to intake the sludge that usually accumulates at the bottom of a fuel tank.

When the fuel in tank 18 is filled to the level indicated by the dashed fuel level 142, the filter 44 will assume the position indicated by the dashed oil filter 144 in FIG. 10. The lines 48 and 46 are made of flexible tubing, such as plastic or rubber, and they will flex to allow the filter 49 to float in the position of dashed fuel filter 144. The overall bouyancy of the filter 49 is chosen so that it will float near, but not on, the surface of the oil.

The position of float 134 at the bottom of filter 49 is important in that it will also act as a spacer to prevent the filter 49 from directly engaging the sidewalls of the tank. Thus, the perforated container 120 of the filter 49 is kept away from the sidewalls of tank 18 where sludge and other impurities may accumulate, and, in this manner, the likelihood of the filter clogging is reduced.

Although a preferred embodiment has been described in the foregoing Detailed Description, it will be understood that the invention is capable of numerous rearrangements, modifications and substitutions of parts without departing from the spirit of the invention and the above Detailed Description is not intended to limit the scope of the invention as set forth in the following claims.

What is claimed is:

1. An oil combustion system for transmitting and burning oil from a reservoir comprising:

a pressure reducing fitting having at least one high pressure input, at least one low pressure output and at least one other output and being operable, when oil under pressure is supplied to the high pressure input, to transmit oil to the low pressure output and to reduce the pressure of the oil at the low pressure output relative to the oil pressure at the high pressure input, said low pressure output being disposed between said high pressure input and said other output with said low pressure output being downstream from said high pressure input and upstream from said other output;

means for supplying oil under pressure to the high pressure input of the pressure reducing fitting;

first oil conduit means having first and second ends and being connected at the first end thereof to the low pressure output of the pressure reducing fitting;

second oil conduit means connected to transfer oil from said other output to the oil reservoir;

venturi means disposed within said pressure reducing fitting for generating by a venturi effect a low pressure volume of oil adjacent said low pressure output relative to the oil pressure at said input; and siphon nozzle means connected to receive oil through the second end of said oil conduit means for siphoning oil from the low pressure output of said pressure reducing fitting through said oil conduit means and for atomizing the oil to prepare it for burning.

2. The system of claim 1 wherein said pressure reducing fitting comprises:

a high pressure input for receiving oil from the reservoir under pressure;

a high pressure output interconnected with said high pressure input for returning the oil to the reservoir;

a low pressure output for supplying oil to said siphon nozzle through said oil conduit means; and obstruction means disposed proximately to said low pressure output for obstructing the flow of oil, creating a venturi effect and reducing the pressure of the oil presented at the low pressure output to a predetermined low oil pressure relative to the oil pressure at the high pressure input.

3. The system of claim 2 wherein an oil flow path is formed between said high pressure input and said high pressure output and said obstruction means is disposed at least partially within said flow path.

4. The system of claim 3 wherein an oil flow path is formed between said high pressure input and said high pressure output and said obstruction means comprises:

a cylinder mounted in said low pressure output and extending therefrom into said oil flow path; and a slot formed longitudinally in said cylinder and being disposed in said oil flow path in an orientation facing the high pressure output whereby said cylinder and slot create a venturi effect and a low pressure volume at said low pressure output relative to the oil pressure at said high pressure input.

5. The system of claim 1 wherein said siphon nozzle means comprises a siphon nozzle connected to a source of compressed air that meters the amount of oil siphoned through the nozzle to burn a predetermined amount of oil per unit time in proportion to the pressure of the compressed air.

6. The system of claim 1 further comprising a positive temperature co-efficient thermistor attached to said siphon nozzle means for heating the oil prior to burning it.

7. An oil combustion system for transmitting an burning oil from a reservoir comprising:

a pressure reducing fitting having at least one high pressure input and at least one low pressure output and being operable, when oil under pressure is supplied to the high pressure input, to transmit oil to the low pressure output and to reduce the pressure of the oil at the low pressure output relative to the pressure at the high pressure input;

means for supplying oil under pressure to the high pressure input of the pressure reducing fitting;

oil conduit means having first and second ends and being connected at the first end thereof to the low pressure output of the pressure reducing fitting;

siphon nozzle means connected to receive oil through the second end of said oil conduit means for siphoning oil from the low pressure output of said pressure reducing fitting through said oil conduit and for atomizing the oil to prepare it for burning, said siphon nozzle means comprising:

a block;

an oil input port formed in said block for receiving oil form said oil conduit means;

at least one oil retention chamber formed in said block for receiving and retaining oil from said oil input port;

a nozzle socket;

an oil output port formed in said block for receiving oil from said oil retention chamber and transmitting it to said nozzle socket;

a compressed air input for supplying compressed air to the nozzle socket; and a nozzle configured to fit within said nozzle socket for receiving and mixing compressed air and oil and being operable, when compressed air is supplied to the nozzle through the compressed air input, to produce a siphon at said oil output port to siphon oil therefrom and through said nozzle.

8. The system of claim 7 further comprising means for heating the block to heat the oil in said oil retention chamber.

9. The system of claim 7 wherein said means for heating comprises a positive temperature coefficient thermistor mounted on said block adjacent said oil retention chamber.

10. The system of claim 7 wherein said at least one retention chamber is configured to retain oil when the system is not burning oil and to provide an air passage between said oil output port and oil input port so that said nozzle may be air purged by providing an air suction of said oil input port.

11. The system of claim 7 wherein said at least one oil retention chamber comprises:

a first oil retention chamber;

a second oil retention chamber;

an oil passageway extending between the first and second oil retention chambers;

said oil input port being formed in said block to supply oil to said first oil retention chamber;

said oil output port being formed in said block to receive oil from said second oil retention chamber;

said first and second oil retention chambers being configured to retain oil when the system is not burning oil; and said oil passageway being positioned to function as an air passage between said oil input port and said oil output port when the system is not burning oil so that said nozzle may be air purged by providing an air siphon at said oil input port.

12. The system of claim 7 further comprising at least one heat transfer plug secured in said block within and encompassed by said at least one oil retention chamber in a spaced apart relationship to baffle oil within the chamber and to transfer heat from said block to the oil within said at least one oil retention chamber.

13. The system of claim 1 wherein said means for supplying oil under pressure comprises:

an oil pump having an output and an intake;

a first oil conduit connected between the output of said pump and the high pressure input of the pressure reducing fitting;

an oil reservoir containing oil;

a second oil conduit means connected between the intake of said pump and the oil reservoir; and a filter disposed within said oil reservoir for filtering and supplying oil to the second oil conduit means and having a bouyancy sufficient to float in the oil within said reservoir at a position spaced from the bottom of the reservoir.

14. The system of claim 13 wherein said filter comprises:

a perforated container for filtering contaminants from oil;

an intake disposed within said container for intaking oil and supplying it to said second oil conduit means; and a float attached to said container for floating said container at least above the bottom of said oil reservoir.

15. The system of claim 7 further comprising:

means for heating said block; and conduit means formed in said block extending from said compressed air input to said nozzle socket whereby air is heated as it travels to said nozzle.

16. The system of claim 7 further comprising means for heating the compressed air before it is supplied to said nozzle.

* * * * *

UNITED STATES PATENT AND TRADEMARK OFFICE

CERTIFICATE OF CORRECTION

PATENT NO. : 4,487,571

DATED : December 11, 1984

INVENTOR(S) : Wayne Robertson; Eugene C. Briggs; & Keith E. Briggs

It is certified that error appears in the above—identified patent and that said Letters Patent is hereby corrected as shown below:

Column 7, line 50, "rentention" should be -- retention --.

Column 8, line 5, "30609-0" should be -- 30609-9 --.

Signed and Sealed this

*Fourteenth* Day of *May 1985*

[SEAL]

*Attest:*

DONALD J. QUIGG

*Attesting Officer* *Acting Commissioner of Patents and Trademarks*